US012509849B2

(12) United States Patent
Kamimae

(10) Patent No.: US 12,509,849 B2
(45) Date of Patent: Dec. 30, 2025

(54) MOTOR GRADER AND METHOD OF CONTROLLING MOTOR GRADER

(71) Applicant: KOMATSU LTD., Tokyo (JP)

(72) Inventor: Takeshi Kamimae, Tokyo (JP)

(73) Assignee: KOMATSU LTD., Tokyo (JP)

( * ) Notice: Subject to any disclaimer, the term of this patent is extended or adjusted under 35 U.S.C. 154(b) by 741 days.

(21) Appl. No.: 17/797,511

(22) PCT Filed: Jan. 6, 2021

(86) PCT No.: PCT/JP2021/000145
§ 371 (c)(1),
(2) Date: Aug. 4, 2022

(87) PCT Pub. No.: WO2021/186850
PCT Pub. Date: Sep. 23, 2021

(65) Prior Publication Data

US 2023/0089245 A1 Mar. 23, 2023

(30) Foreign Application Priority Data

Mar. 18, 2020 (JP) ..... 2020-047640

(51) Int. Cl.
*E02F 3/76* (2006.01)
*E02F 3/84* (2006.01)
*E02F 9/26* (2006.01)

(52) U.S. Cl.
CPC ..... *E02F 3/7668* (2013.01); *E02F 3/7636* (2013.01); *E02F 3/841* (2013.01); *E02F 9/264* (2013.01)

(58) Field of Classification Search
CPC ..... E02F 3/7668; E02F 3/7636; E02F 3/841; E02F 9/264; E02F 3/7645; E02F 3/765; E02F 3/844; E02F 9/265; E02F 3/764
See application file for complete search history.

(56) References Cited

U.S. PATENT DOCUMENTS 3,899,028 A * 8/1975 Morris ..... E02F 3/845 172/4.5
6,295,746 B1 * 10/2001 Meduna ..... E02F 3/847 91/33

(Continued)

FOREIGN PATENT DOCUMENTS

JP H01-284623 A 11/1989
JP 2017-172190 A 9/2017

*Primary Examiner* — Ig T An
(74) *Attorney, Agent, or Firm* — Faegre Drinker Biddle & Reath LLP

(57) ABSTRACT

A motor grader includes an operation apparatus, a front frame, a draw bar swingably attached to the front frame, a first actuator attached to the draw bar, the first actuator moving the draw bar in a lateral direction with respect to the front frame, a second actuator attached to the draw bar, the second actuator moving the draw bar in a direction toward the front frame and a direction away from the front frame, and a controller that causes the first actuator and the second actuator to operate. The controller causes the first actuator and the second actuator to operate based on an operation signal received from the operation apparatus such that a position of the draw bar with respect to the front frame comes closer to a neutral position of the draw bar with respect to the front frame.

16 Claims, 9 Drawing Sheets

(56) References Cited

U.S. PATENT DOCUMENTS

| | | | | |
|---|---|---|---|---|
| 2002/0166267 | A1* | 11/2002 | McGugan | E02F 9/2004 37/348 |
| 2008/0185162 | A1* | 8/2008 | Maeda | E02F 3/7668 172/781 |
| 2016/0108604 | A1 | 4/2016 | West et al. | |
| 2018/0106014 | A1 | 4/2018 | Horstman et al. | |
| 2019/0017242 | A1 | 1/2019 | Yamamoto | |

* cited by examiner

MOTOR GRADER AND METHOD OF CONTROLLING MOTOR GRADER

TECHNICAL FIELD

The present disclosure relates to a motor grader and a method of controlling a motor grader.

BACKGROUND ART

A motor grader has conventionally been known as a work vehicle. The motor grader includes a work implement including a draw bar, a swing circle, a blade, and the like.

For example, US Patent Publication No. 2018/0106014 (PTL 1) discloses a motor grader that automatically moves a work implement to a forwarding position when an operator operates a switch for automatic transport control provided in a control lever. According to such a configuration, PTL 1 saves time and trouble of an operator in forwarding a motor grader with transport means.

CITATION LIST

Patent Literature

PTL 1: US Patent Publication No. 2018/0106014

SUMMARY OF INVENTION

Technical Problem

The operator moves a blade toward or away from a front frame by causing a pair of left and right lift cylinders to operate during works. At that time, when the draw bar is not located at a neutral position with respect to a front frame, an amount of upward/downward movement of a left end of the blade at the time when the operator operates a left lift cylinder by a certain amount is different from an amount of upward/downward movement of a right end of the blade at the time when the operator operates a right lift cylinder by an amount equal to the amount of movement of the left lift cylinder.

Therefore, as the draw bar is located at a position more distant from the neutral position, it is more difficult for an operator who is not skilled in operation to move the blade to a desired position.

The present disclosure was made in view of the problem above, and an object thereof is to provide a motor grader capable of lessening burdens imposed on an operator in operating a work implement and a method of controlling a motor grader.

Solution to Problem

According to one aspect of the present disclosure, a motor grader includes an operation apparatus, a front frame, a draw bar swingably attached to the front frame, a first actuator attached to the draw bar, the first actuator moving the draw bar in a lateral direction with respect to the front frame, a second actuator attached to the draw bar, the second actuator moving the draw bar in a direction toward the front frame and a direction away from the front frame, and a controller that causes the first actuator and the second actuator to operate. The controller receives an operation signal from the operation apparatus, and causes the first actuator and the second actuator to operate based on the received operation signal such that a position of the draw bar with respect to the front frame comes closer to a neutral position of the draw bar with respect to the front frame.

According to another aspect of the present disclosure, a method of controlling a motor grader is provided. The motor grader includes an operation apparatus, a draw bar swingably attached to a front frame, a first actuator attached to the draw bar, the first actuator moving the draw bar in a lateral direction with respect to the front frame, and a second actuator attached to the draw bar, the second actuator moving the draw bar in a direction toward the front frame and a direction away from the front frame. The method of controlling a motor grader includes receiving an operation signal from the operation apparatus based on an operation performed onto the operation apparatus and causing the first actuator and the second actuator to operate based on reception of the operation signal from the operation apparatus such that a position of the draw bar with respect to the front frame comes closer to a neutral position of the draw bar with respect to the front frame.

Advantageous Effects of Invention

According to the present disclosure, burdens imposed on an operator in operating a work implement can be lessened.

DESCRIPTION OF EMBODIMENTS

Figure 1:
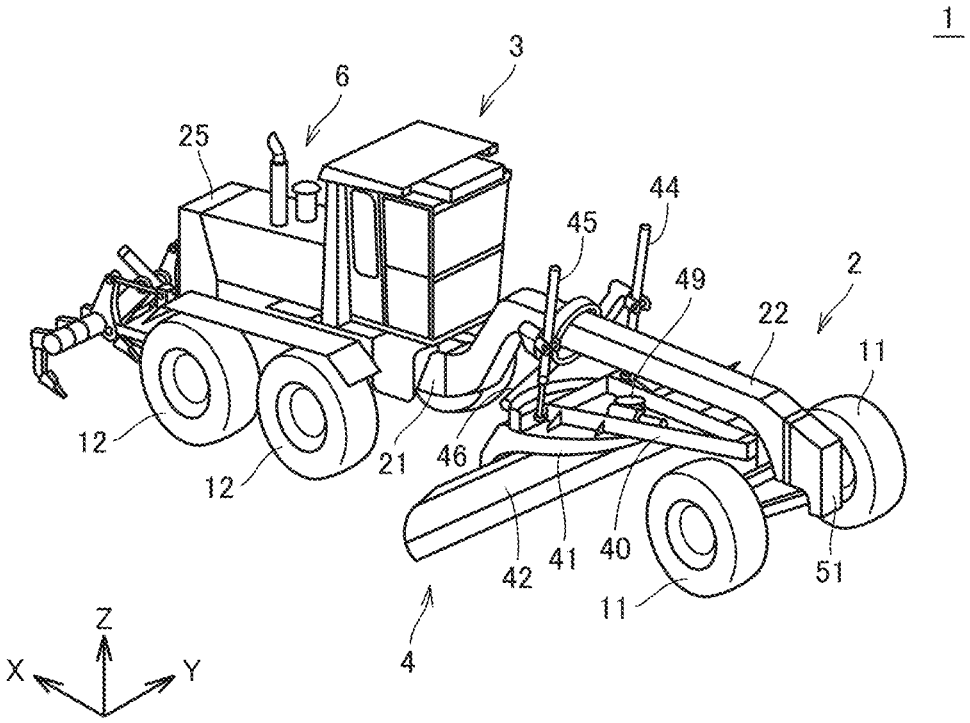
FIG. 1 is a perspective view schematically showing a construction of a motor grader.

A motor grader work vehicle according to an embodiment of the present invention will be described below with reference to the drawings. In the description below, the same elements have the same reference characters allotted and their labels and functions are also the same. Therefore, detailed description thereof will not be repeated.

<A. Schematic Construction of Motor Grader>

FIG. 1 is a perspective view schematically showing a construction of a motor grader 1 based on the present embodiment. As shown in FIG. 1, motor grader 1 mainly includes a front wheel 11, a rear wheel 12, a vehicular body frame 2, a cab 3, and a work implement 4. Motor grader 1 includes components such as an engine arranged in an engine compartment 6. Work implement 4 includes a blade 42. Motor grader 1 does such works as land-grading works, snow removal works, light cutting, and mixing of materials with blade 42.

In the description of the drawings below, a direction in which motor grader 1 travels in straight lines is referred to as a fore/aft direction of motor grader 1. In the fore/aft direction of motor grader 1, a side where front wheel 11 is arranged with respect to work implement 4 is defined as the fore direction. In the fore/aft direction of motor grader 1, a side where rear wheel 12 is arranged with respect to work implement 4 is defined as the aft direction.

A lateral direction of motor grader 1 is a direction orthogonal to the fore/aft direction in a plan view. A right side and a left side in the lateral direction in facing front are defined as a right direction and a left direction, respectively. An upward/downward direction of motor grader 1 is a direction orthogonal to the plane defined by the fore/aft direction and the lateral direction. A side in the upward/downward direction where the ground is located is defined as a lower side and a side where the sky is located is defined as an upper side.

The fore/aft direction refers to a fore/aft direction of an operator who sits at an operator's seat in cab 3. The lateral direction refers to a lateral direction of the operator who sits at the operator's seat. The lateral direction refers to a direction of a vehicle width of motor grader 1. The upward/downward direction refers to an upward/downward direction of the operator who sits at the operator's seat. A direction in which the operator sitting at the operator's seat faces is defined as the fore direction and a direction behind the operator sitting at the operator's seat is defined as the aft direction. A right side and a left side at the time when the operator sitting at the operator's seat faces front are defined as the right direction and the left direction, respectively. A foot side of the operator who sits at the operator's seat is defined as a lower side, and a head side is defined as an upper side.

In the present example, the fore direction corresponds to a negative direction along an X axis in the drawing. The aft direction corresponds to a positive direction along the X axis. The left direction corresponds to the positive direction along a Y axis. The right direction corresponds to the negative direction along the Y axis. The upward direction corresponds to the positive direction along a Z axis. The downward direction corresponds to the negative direction along the Z axis.

Vehicular body frame 2 extends in the fore/aft direction. Vehicular body frame 2 includes a rear frame 21 and a front frame 22.

Rear frame 21 supports an exterior cover 25 and components such as an engine arranged in engine compartment 6. Exterior cover 25 covers engine compartment 6. For example, each of four rear wheels 12 is attached to rear frame 21 as being rotatably driven by driving force from the engine.

Front frame 22 is attached in front of rear frame 21. Front frame 22 is pivotably coupled to rear frame 21. Front frame 22 extends in the fore/aft direction. Front frame 22 includes a base end portion coupled to rear frame 21 and a tip end portion opposite to the base end portion. The base end portion of front frame 22 is coupled to the tip end portion of rear frame 21 with a vertical central pin being interposed.

An articulation cylinder (not shown) is attached between front frame 22 and rear frame 21. Front frame 22 is provided as being pivotable with respect to rear frame 21 owing to extending and retracting of the articulation cylinder. The articulation cylinder is provided as being extensible and retractable in response to an operation of a control lever provided in cab 3.

For example, two front wheels 11 are rotatably attached to the tip end portion of front frame 22. Front wheel 11 is attached to front frame 22 as being revolvable owing to extending and retracting of a steering cylinder (not shown). Motor grader 1 can change its direction of travel owing to extending and retracting of the steering cylinder. The steering cylinder can extend and retract in response to an operation of a steering wheel or a steering control lever provided in cab 3.

A counter weight 51 is attached to a front end of vehicular body frame 2. Counter weight 51 represents one type of attachments to be attached to front frame 22. Counter weight 51 is attached to front frame 22 in order to increase a downward load to be applied to front wheel 11 to allow steering and to increase a pressing load on blade 42.

Cab 3 is carried on front frame 22. In cab 3, an operation portion (not shown) such as a steering wheel, a gear shift lever, a lever for controlling work implement 4, a brake, an accelerator pedal, an inching pedal, and various switches is provided. Cab 3 may be carried on rear frame 21.

<B. Construction of Main Part of Work Implement>

Figure 2:
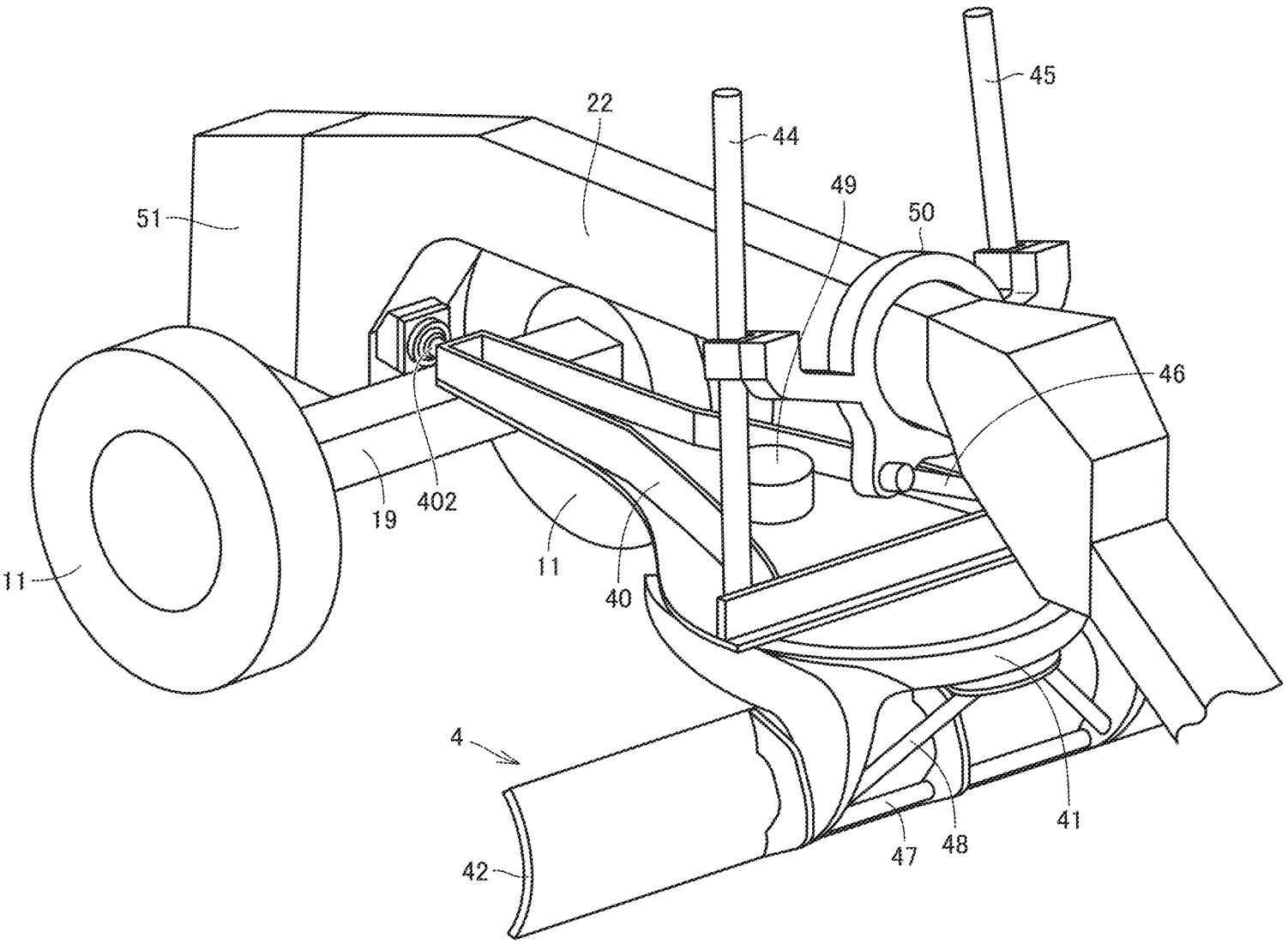
FIG. 2 is an enlarged perspective view showing a main part of a work implement of the motor grader.

FIG. 2 is an enlarged perspective view showing a main part of work implement 4 of motor grader 1 shown in FIG. 1. As shown in FIG. 2, work implement 4 mainly includes a draw bar 40, a swing circle 41, and blade 42.

Draw bar 40 is arranged below front frame 22. Draw bar 40 is moved by a pair of lift cylinders 44 and 45 to move in a direction toward front frame 22 (a direction in which blade 42 moves away from the ground) and a direction away from front frame 22.

Draw bar 40 has a front end portion coupled to the tip end portion of front frame 22 with a ball bearing portion 402. Draw bar 40 has the front end portion swingably attached to the tip end portion of front frame 22. Draw bar 40 has a rear end portion supported on front frame 22 by lift cylinders 44 and 45.

Owing to extending and retracting of lift cylinders 44 and 45, the rear end portion of draw bar 40 can move up and down with respect to front frame 22. Draw bar 40 is vertically swingable with an axis along a direction of travel of the vehicle being defined as the center, as a result of extending and retracting of lift cylinders 44 and 45. As a result of extending and retracting of a draw bar shift cylinder 46, draw bar 40 is movable laterally with respect to front frame 22.

Lift cylinders 44 and 45 are attached to draw bar 40 and a bracket 50. Lift cylinders 44 and 45 each have a head attached to bracket 50. A tip end portion of a rod of each of lift cylinders 44 and 45 is attached to draw bar 40. Bracket 50 is attached to front frame 22.

Draw bar shift cylinder 46 is attached to draw bar 40 and bracket 50. A tip end portion of a head of draw bar shift cylinder 46 is attached to draw bar 40. A tip end portion of a rod of draw bar shift cylinder 46 is attached to bracket 50.

Swing circle 41 is arranged below front frame 22. Swing circle 41 is arranged below draw bar 40. Swing circle 41 is revolvably (rotatably) supported on the rear end portion of draw bar 40. Swing circle 41 can be driven by a slewing motor 49 as being revolvable clockwise and counterclockwise with respect to draw bar 40 when viewed from above the vehicle. Blade 42 is disposed on swing circle 41. As swing circle 41 is driven to revolve, a blade propulsive angle of blade 42 is adjusted. As will be described in detail later with reference to FIG. 4, the blade propulsive angle refers to an angle of inclination of blade 42 with respect to the fore/aft direction of motor grader 1.

Blade 42 is arranged between front wheel 11 and rear wheel 12. Front wheel 11 is arranged in front of blade 42. Rear wheel 12 is arranged in the rear of blade 42. Blade 42 is arranged between the front end of vehicular body frame 2 and a rear end of vehicular body frame 2. Blade 42 is supported on swing circle 41. Blade 42 is supported on draw bar 40 with swing circle 41 being interposed. Blade 42 is supported on front frame 22 with swing circle 41 and draw bar 40 being interposed.

Blade 42 is supported as being movable in the lateral direction with respect to swing circle 41. Specifically, a blade shift cylinder 47 is attached to swing circle 41 and blade 42 and arranged along a longitudinal direction of blade 42. With blade shift cylinder 47, blade 42 is movable in the lateral direction with respect to swing circle 41. Blade 42 is movable in a direction intersecting with a longitudinal direction of front frame 22.

Blade 42 is supported as being swingable around an axis extending in the longitudinal direction of blade 42 with respect to swing circle 41. Specifically, a tilt cylinder 48 is attached to swing circle 41 and blade 42. As a result of extending and retracting of tilt cylinder 48, blade 42 swings around the axis extending in the longitudinal direction of blade 42 with respect to swing circle 41, so that an angle of inclination of blade 42 with respect to the direction of travel of the vehicle can be changed.

As set forth above, blade 42 is constructed to be able to move up and down with respect to the vehicle, swing around the axis along the direction of travel of the vehicle, change an angle of inclination with respect to the fore/aft direction, move in the lateral direction, and swing around the axis extending in the longitudinal direction of blade 42, with draw bar 40 and swing circle 41 being interposed.

In the present example, a case in which the position of blade 42 with respect to swing circle 41 coincides with the neutral position and the position of draw bar 40 with respect to front frame 22 coincides with the neutral position is referred to as a "neutral position of work implement 4."

<C. Functional Configuration>

Figure 3:
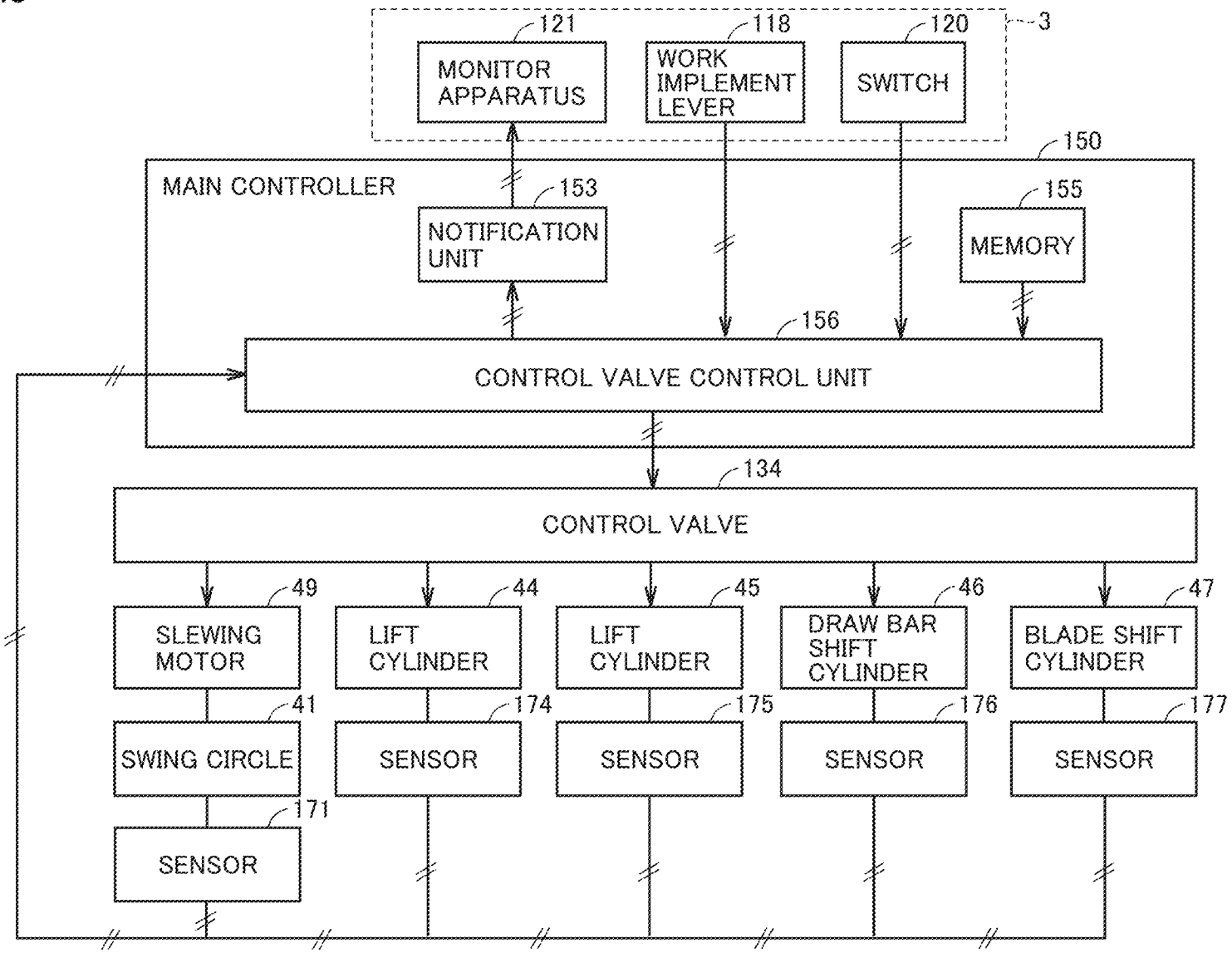
FIG. 3 is a functional block diagram illustrating a functional configuration of a control system of the motor grader.

FIG. 3 is a functional block diagram illustrating a functional configuration of a control system of motor grader 1.

FIG. 3 shows relation between a main controller 150 and other peripheral devices. A work implement lever 118, a switch 120, a monitor apparatus 121, a control valve 134, sensors 171 and 174 to 177, slewing motor 49, lift cylinders 44 and 45, and swing circle 41 are shown as the peripheral devices.

Work implement 118, switch 120, and monitor apparatus 121 are provided in cab 3.

Main controller 150 is a controller that controls the entire motor grader 1. Main controller 150 is implemented by a central processing unit (CPU), a non-volatile memory where a program is stored, and the like.

Main controller 150 controls monitor apparatus 121, control valve 134, and the like.

Monitor apparatus 121, work implement lever 118, and switch 120 are connected to main controller 150.

Main controller 150 provides a lever operation signal (an electrical signal) in accordance with an operated state of work implement lever 118 to control valve 134.

Control valve 134 is an electromagnetic proportional valve. Control valve 134 is connected to main controller 150. Main controller 150 provides an operation signal (electrical signal) in accordance with a direction of operation and/or an amount of operation onto work implement lever 118 to control valve 134. Control valve 134 controls an amount of hydraulic oil to be supplied from a hydraulic pump (not shown) to a hydraulic actuator in accordance with the operation signal. Exemplary hydraulic actuators include slewing motor 49, lift cylinders 44 and 45, draw bar shift cylinder 46, blade shift cylinder 47, and tilt cylinder 48.

Main controller 150 includes a notification unit 153, a memory 155, and a control valve control unit 156.

Sensor 171 detects an angle of rotation (typically, a blade propulsive angle θ which will be described later) of swing circle 41. Sensor 171 transmits information on the angle of rotation to control valve control unit 156.

Sensor 174 detects a cylinder length of lift cylinder 44. Sensor 175 detects a cylinder length of lift cylinder 45. Sensor 176 detects a cylinder length of draw bar shift cylinder 46. Sensor 177 detects a cylinder length of blade shift cylinder 47. Results detected by sensors 174 to 177 are transmitted to control valve control unit 156.

Notification unit 153 instructs monitor apparatus 121 to give guidance information in accordance with an instruction from control valve control unit 156.

Various types of information on engine output torque are stored in memory 155. Information on an engine output torque curve is stored in memory 155. A reference value of the cylinder length of draw bar shift cylinder 46 and a reference value of a cylinder length of blade shift cylinder 47 are stored in memory 155.

Control valve control unit 156 controls drive of slewing motor 49 by controlling opening of control valve 134 in accordance with magnitude of a current value which is an operation command to be provided. Control valve control unit 156 receives information on a circle rotation angle from sensor 171. Control valve control unit 156 corrects a current value which is an operation command to control valve 134 based on the information on the circle rotation angle from sensor 171.

Switch 120 is a switch for automatic transition of work implement 4 to the neutral position. Switch 120 is a switch for automatic transition of the position of blade 42 with respect to swing circle 41 to the neutral position of blade 42 (which is also referred to as a "neutral position NB" below) with respect to swing circle 41. Switch 120 is a switch for automatic transition of the position of draw bar 40 with respect to front frame 22 to the neutral position of draw bar 40 (which is also referred to as a "neutral position ND" below) with respect to front frame 22. For example, a push button switch can be employed as switch 120. Motor grader 1 may include a control lever instead of switch 120 for automatic transition of work implement 4 to the neutral position. Motor grader 1 should only include an operation apparatus for automatic transition of work implement 4 to the neutral position.

<D. As to Neutral Position>

Figure 4:
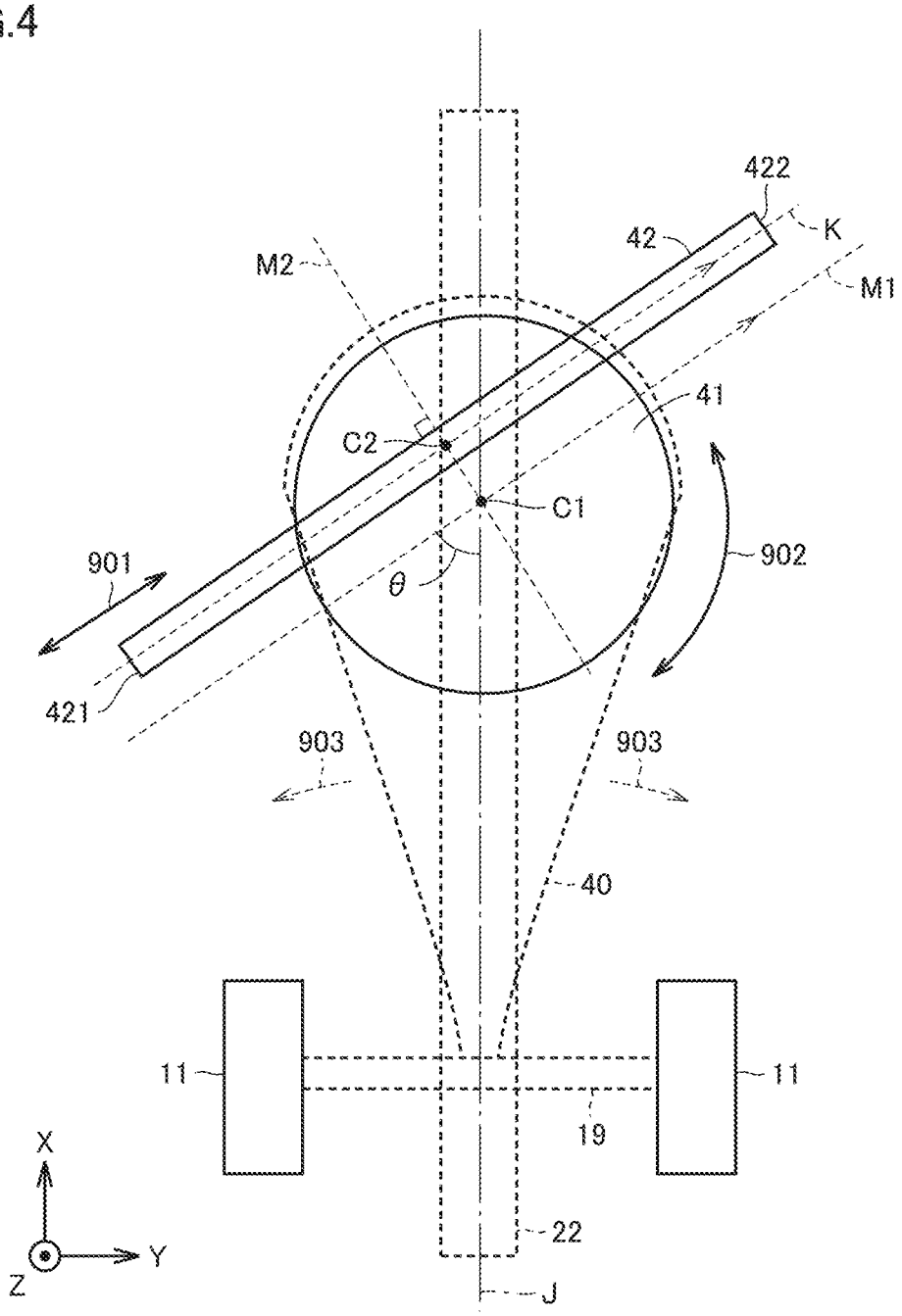
FIG. 4 is a schematic diagram showing a state in which each of a blade and a draw bar is located at a neutral position.

FIG. 4 is a schematic diagram showing a state in which each of blade 42 and draw bar 40 is located at the neutral position.

As shown in FIG. 4, draw bar 40 moves in a direction shown with an arrow 903. Swing circle 41 rotates in a direction shown with an arrow 902. Blade 42 moves in a direction shown with an arrow 901. Blade 42 rotates around a rotation axis C1 by swing circle 41 being driven to revolve. As blade 42 rotates around rotation axis C1, a blade propulsive angle θ is varied. Blade propulsive angle θ refers to an angle formed between a direction of travel of the vehicular body and blade 42. Blade propulsive angle θ refers to an angle of inclination of blade 42 with respect to the longitudinal direction of front frame 22.

In the following, for the sake of convenience of description, a virtual line orthogonal to rotation axis C1 and in parallel to blade 42 (a centerline K of blade 42) is defined as a line M1. A virtual line orthogonal to rotation axis C1 and orthogonal to line M1 is defined as a line M2. Line M1 and line M2 are assumed as lines in parallel to an XY plane.

Initially, neutral position NB of blade 42 will be described.

The position of blade 42 with respect to swing circle 41 when a central point C2 in the longitudinal direction of blade 42 is located on line M2 is neutral position NB. Central point C2 is intermediate between a right end 421 and a left end 422 of blade 42.

Regardless of an angle of rotation of swing circle 41, when central point C2 is located on line M2, the position of blade 42 with respect to swing circle 41 is neutral position NB. Regardless of a value of blade propulsive angle θ, when central point C2 is located on line M2, the position of blade 42 with respect to swing circle 41 is neutral position NB.

Regardless of the position of draw bar 40, when central point C2 is located on line M2, the position of blade 42 with respect to swing circle 41 is neutral position NB. Regardless of an attitude of draw bar 40, when central point C2 is located on line M2, the position of blade 42 with respect to swing circle 41 is neutral position NB.

Neutral position ND of draw bar 40 will now be described.

When lift cylinders 44 and 45 are identical to each other in cylinder length and rotation axis C1 of swing circle 41 is located on an axial line J of front frame 22, the position of draw bar 40 with respect to front frame 22 is neutral position ND.

When lift cylinders 44 and 45 are identical to each other in cylinder length and axial line of front frame 22 intersects with rotation axis C1 of swing circle 41, the position of draw bar 40 with respect to front frame 22 is neutral position ND.

Regardless of an angle of rotation of swing circle 41, draw bar 40 can be located at neutral position ND. Regardless of the position of blade 42 with respect to swing circle 41, draw bar 40 can be located at neutral position ND.

<E. Automatic Transition to Neutral Position>

An operation of the motor grader when the operator operates switch 120 will be described. Specifically, an operation for automatic transition of work implement 4 to the neutral position will be described. By way of example, an operation to cause blade 42 to make transition to neutral position NB and thereafter to cause draw bar 40 to make transition to neutral position ND will be described.

Specifically, when the operator operates switch 120, an operation to cause blade 42 to make transition to neutral position NB and an operation to cause draw bar 40 to make transition to neutral position ND are successively performed in this order. Examples of the operation onto switch 120 include a press-and-hold operation (a press-down operation lasting for a certain time period or longer).

Typically, when the operator operates switch 120, on condition that motor grader 1 is traveling forward, main controller 150 causes work implement 4 to make automatic transition to the neutral position. During works, motor grader 1 is traveling forward. Therefore, when work implement 4 makes automatic transition to the neutral position while at least motor grader 1 is traveling forward, convenience of the operator is not compromised. By setting forward travel as the condition, work implement 4 does not make automatic transition to the neutral position even when switch 120 is operated in a standstill state.

The condition for automatic transition of work implement 4 to the neutral position, however, does not necessarily require forward travel. Motor grader 1 may be configured such that work implement 4 makes automatic transition to the neutral position even when it is in a standstill state or is traveling rearward.

Automatic transition to the neutral position is made by control by control valve control unit 156 within main controller 150. Typically, automatic transition to the neutral position is made by execution of a program (control program) within the memory by the CPU. Automatic transition to the neutral position may be made by a semiconductor integrated circuit (an application specific integrated circuit (ASIC)).

Figure 5:
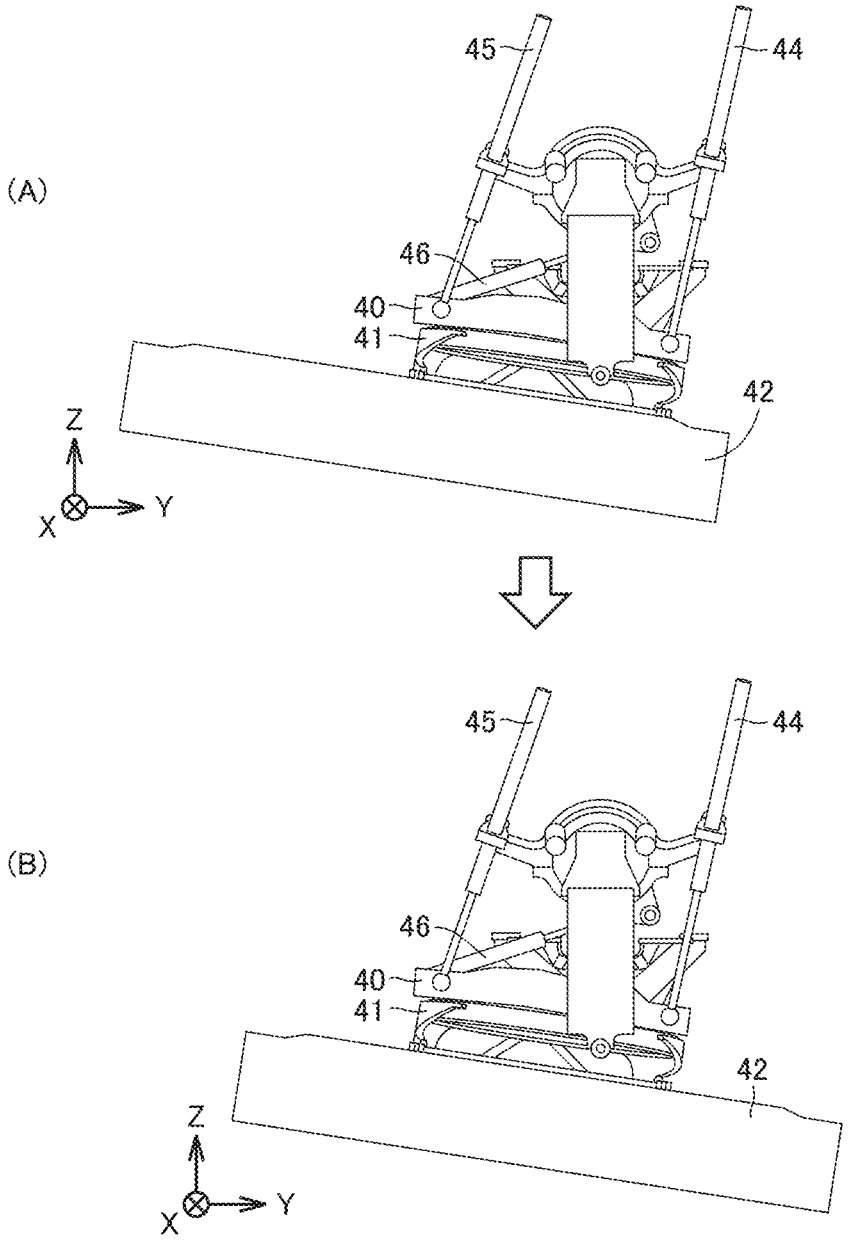
FIG. 5 is a diagram for illustrating an operation for causing the blade to make transition to the neutral position.
Figure 6:
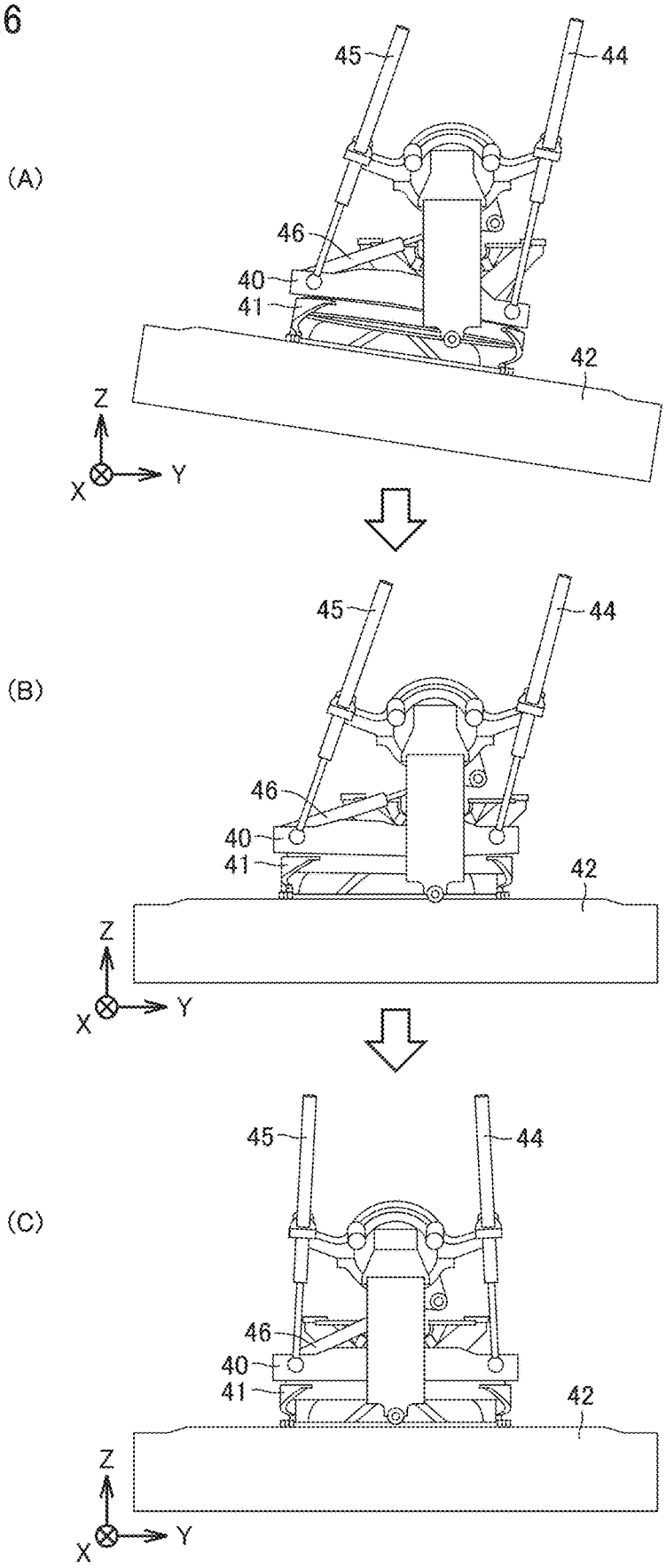
FIG. 6 is a diagram for illustrating an operation for causing the draw bar to make transition to the neutral position.
Figure 7:
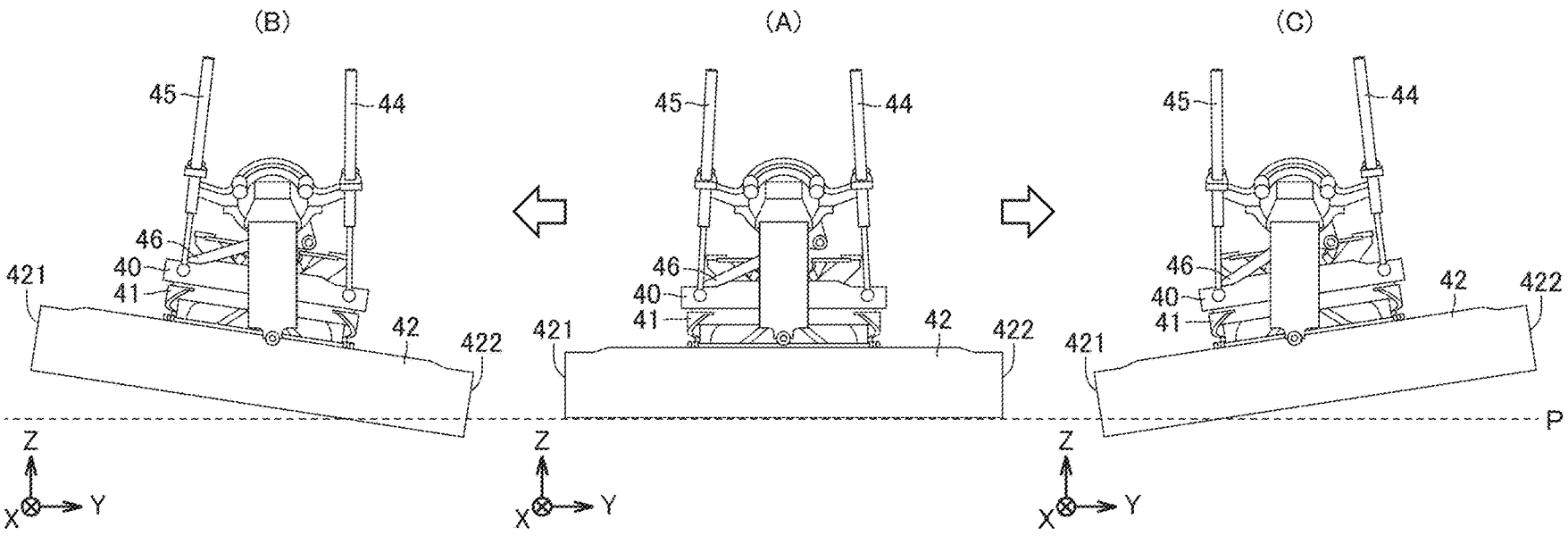
FIG. 7 is a diagram for illustrating an advantage obtained by causing the work implement to make transition to the neutral position during works.

FIGS. 5 to 7 below show only a main part of motor grader 1 for facilitating understanding of operations of draw bar 40, swing circle 41, blade 42, lift cylinders 44 and 45, and draw bar shift cylinder 46. FIGS. 5 to 7 do not show, for example, front wheel 11.

(e1. Transition of Blade 42 to Neutral Position NB)

FIG. 5 is a diagram for illustrating an operation for causing blade 42 to make transition to neutral position NB.

Referring to FIG. 5, in a state (A), the position of blade 42 with respect to swing circle 41 is displaced from neutral position NB to the right (the negative direction along the Y axis). In the state (A), the position of draw bar 40 with respect to front frame 22 is also displaced from neutral position ND to the right. Lift cylinder 44 is longer in cylinder length than lift cylinder 45.

When the operator operates switch 120 in the state (A), main controller 150 (specifically, control valve control unit 156) causes blade shift cylinder 47 (see FIG. 2) to operate such that the position of blade 42 with respect to swing circle 41 comes closer to neutral position NB. Main controller 150 causes blade shift cylinder 47 to operate such that the position of blade 42 reaches neutral position NB. When the position of blade 42 reaches neutral position NB, main controller 150 stops the operation of blade shift cylinder 47.

Through processing above, the state of motor grader 1 makes transition from the state (A) to a state (B). During transition from the state (A) to the state (B), the cylinder length of each of lift cylinders 44 and 45 and the cylinder length of draw bar shift cylinder 46 do not change. Main controller 150 causes blade shift cylinder 47 to operate such that the position of blade 42 comes closer to neutral position NB while the cylinder length of each of lift cylinders 44 and 45 is maintained at a length at the time when switch 120 is operated.

More specific description is as below. In memory 155 (see FIG. 3) of main controller 150, the cylinder length (corresponding to the reference value above) of blade shift cylinder 47 at which the position of blade 42 coincides with neutral position NB is stored in advance. Main controller 150 causes blade shift cylinder 47 to operate based on the operation onto switch 120 until the cylinder length detected by sensor 177 (see FIG. 3) attains to the cylinder length at which the position of blade 42 coincides with neutral position NB.

(e2. Transition of Draw Bar 40 to Neutral Position ND)

Main controller 150 causes lift cylinders 44 and 45 and draw bar shift cylinder 46 to operate based on completion of the operation of blade shift cylinder 47 such that the position of draw bar 40 with respect to front frame 22 comes closer to neutral position ND. Main controller 150 causes lift cylinders 44 and 45 and draw bar shift cylinder 46 to operate such that the position of draw bar 40 with respect to front frame 22 reaches neutral position ND.

FIG. 6 is a diagram for illustrating an operation for causing draw bar 40 to make transition to neutral position ND.

Referring to FIG. 6, a state (A) shows a state the same as the state (B) in FIG. 5. Transition from the state (A) to a state (B) is based on the operation of lift cylinders 44 and 45. Transition from the state (B) to a state (C) is based on the operation of draw bar shift cylinder 46.

(1) Operation of Lift Cylinders 44 and 45

Main controller 150 causes lift cylinders 44 and 45 to operate based on completion of the operation of blade shift cylinder 47 (the state (A)). Main controller 150 causes lift cylinders 44 and 45 to operate to thereby control the cylinder lengths of lift cylinders 44 and 45 to be equal to each other. Main controller 150 causes at least one of lift cylinders 44 and 45 to operate such that the cylinder length of lift cylinder 44 is equal to the cylinder length of lift cylinder 45. Main controller 150 stops the operation of lift cylinders 44 and 45 when lift cylinder 44 and lift cylinder 45 become equal in cylinder length to each other as shown in the state (B).

In the example in FIG. 6, main controller 150 causes lift cylinder 44 to operate such that the cylinder length of lift cylinder 44 is equal to the cylinder length of lift cylinder 45. Since lift cylinder 44 is longer in cylinder length than lift cylinder 45, main controller 150 sets the cylinder length of lift cylinder 44 and the cylinder length of lift cylinder 45 to be equal to each other by decreasing the cylinder length of lift cylinder 44. By thus controlling the cylinder length of one lift cylinder to be shorter, blade 42 can be prevented from digging into the ground at the time when draw bar shift cylinder 46 is caused to operate.

Without being limited as such, main controller 150 may cause lift cylinder 45 to operate such that the cylinder length of lift cylinder 45 is equal to the cylinder length of lift cylinder 44. Alternatively, main controller 150 may cause lift cylinders 44 and 45 to operate such that the cylinder length of lift cylinder 44 and the cylinder length of lift cylinder 45 are set to a value (for example, an average value) between current cylinder lengths. According to such processing, a time period required for setting lift cylinder 45 and lift cylinder 44 to be equal in cylinder length to each other can be reduced.

Through processing above, the state of motor grader 1 makes transition from the state (A) to the state (B). During transition from the state (A) to the state (B), the cylinder length of draw bar shift cylinder 46 and the cylinder length of blade shift cylinder 47 do not change.

More specific description is as below. Main controller 150 determines a target cylinder length based on the cylinder length detected by sensor 174 (see FIG. 3) and the cylinder length detected by sensor 175 at the time when switch 120 is operated. For example, main controller 150 determines the cylinder length detected by sensor 174 (or sensor 175) as the target cylinder length. Alternatively, main controller 150 determines an average value of the cylinder length detected by sensor 174 and the cylinder length detected by sensor 175 as the target cylinder length.

Main controller 150 controls the cylinder lengths of lift cylinders 44 and 45 to be equal to each other by controlling the cylinder length of each of lift cylinders 44 and 45 to the target cylinder length. When the cylinder length of one lift cylinder is set as the target cylinder length as above, only the other lift cylinder should only be caused to operate.

(2) Operation of Draw Bar Shift Cylinder 46

Main controller 150 causes draw bar shift cylinder 46 to operate such that the position of draw bar 40 comes closer to neutral position ND on condition that the cylinder lengths of lift cylinders 44 and 45 have become equal to each other (the state (B)). Main controller 150 causes draw bar shift cylinder 46 to operate such that the position of draw bar 40 reaches neutral position ND. Main controller 150 stops the operation of draw bar shift cylinder 46 when the position of draw bar 40 reaches neutral position ND.

Through processing above, the state of motor grader 1 makes transition from the state (B) to the state (C). During transition from the state (B) to the state (C), the cylinder lengths of lift cylinders 44 and 45 and the cylinder length of blade shift cylinder 47 do not change.

More specific description is as below. The cylinder length (corresponding to the reference value above) of draw bar shift cylinder 46 at which the position of draw bar 40 coincides with neutral position ND at the time when the cylinder lengths of lift cylinders 44 and 45 are set to the target cylinder length is stored in advance in memory 155 of main controller 150.

Typically, the cylinder length of draw bar shift cylinder 46 at which the position of draw bar 40 coincides with neutral position ND within a numerical range of cylinder lengths where lift cylinders 44 and 45 are identical to each other in cylinder length is stored in advance in memory 155. Specifically, the value within the numerical range and the cylinder length of draw bar shift cylinder 46 at which the position of draw bar 40 coincides with neutral position ND at the time when the former value is attained to are stored in association with each other. For example, the value within the numerical range and the cylinder length of draw bar shift cylinder 46 at which the position of draw bar 40 coincides with neutral position ND at the time when that value is attained to are stored in association with each other as a function or a data table in memory 155.

Thus, with main controller 150, when the cylinder lengths (the identical cylinder lengths) of lift cylinders 44 and 45 are determined, the cylinder length of draw bar shift cylinder 46 at which the position of draw bar 40 coincides with neutral position ND is uniquely determined.

Main controller 150 causes draw bar shift cylinder 46 to operate until the cylinder length detected by sensor 176 (see FIG. 3) attains to the cylinder length at which the position of draw bar 40 coincides with neutral position ND.

When the position of blade 42 reaches neutral position NB and the position of draw bar 40 with respect to front frame 22 reaches neutral position ND, main controller 150 may cause monitor apparatus 121 to show that work implement 4 has reached the neutral position. According to such representation, the operator can know that work implement 4 has reached the neutral position.

(e3. Advantage)

FIG. 7 is a diagram for illustrating an advantage obtained by causing work implement 4 to make transition to the neutral position during works.

Referring to FIG. 7, a state (A) in the center shows a state the same as the state (C) in FIG. 6. A line P represents a position of a lower end of blade 42 in the state (A).

A state (B) shows a state in which the cylinder length of lift cylinder 45 has been reduced by a prescribed length (any length) by an operation by the operator from the state (A). A state (C) shows a state in which the cylinder length of lift cylinder 44 has been reduced by the prescribed length from the state (A).

The cylinder length of lift cylinder 45 in the state (B) is equal to the cylinder length of lift cylinder 44 in the state (C). The cylinder length of lift cylinder 44 in the state (B) and the cylinder length of lift cylinder 45 in the state (C) are equal to each other, because they do not change.

In this case, an amount of upward movement (an amount of movement in the upward direction) of right end 421 of blade 42 in the state (B) is the same as an amount of upward movement of left end 422 of blade 42 in the state (C). An amount of lowering (an amount of movement in the downward direction) of left end 422 of blade 42 in the state (B) is the same as an amount of lowering of right end 421 of blade 42 in the state (C).

Thus, when blade 42 is located at neutral position NB and draw bar 40 is located at neutral position ND as in the state (A), the amount of upward/downward movement of left end 422 of the blade at the time when the operator operates lift cylinder 44 by a certain amount is identical to the amount of upward/downward movement of right end 421 of the blade at the time when the operator operates lift cylinder 45 by an amount the same as the amount of movement of lift cylinder 44.

Therefore, movement of blade 42 to a desired position even by an operator who is not skilled in operation is facilitated as compared with a case in which blade 42 and draw bar 40 are not at neutral positions NB and ND, respectively. Therefore, motor grader 1 can lessen burdens imposed on the operator at the time when the operator operates work implement 4.

An advantage in the case in which blade 42 and draw bar 40 are set to neutral positions NB and ND, respectively, is described above. Even when only blade 42 of blade 42 and draw bar 40 is caused to return to neutral position NB, blade 42 is more easily moved to a desired position than when blade 42 and draw bar 40 are not located at neutral positions NB and ND, respectively. Even when only draw bar 40 of blade 42 and draw bar 40 is caused to return to neutral position ND, blade 42 is more easily moved to a desired position than when blade 42 and draw bar 40 are not located at neutral positions NB and ND, respectively. Therefore, even according to such a configuration, motor grader 1 can lessen burdens imposed on the operator at the time when the operator operates work implement 4.

(e4. Summary)

Thus, the present disclosure includes not only a configuration in which blade 42 and draw bar 40 are set to neutral positions NB and ND, respectively, but also a configuration in which only blade 42 is set to neutral position NB and a configuration in which only draw bar 40 is set to neutral position ND. The configuration of motor grader 1 will be summarized below from a point of view of two latter configurations.

(1) Motor grader 1 includes switch 120, swing circle 41, blade 42 supported on swing circle 41, blade shift cylinder 47 arranged along the longitudinal direction of blade 42, blade shift cylinder 47 moving blade 42 in the lateral direction with respect to swing circle 41, and main controller 150 that causes blade shift cylinder 47 to operate.

Main controller 150 receives an operation signal from switch 120. Main controller 150 causes blade shift cylinder 47 to operate based on the received operation signal such that the position of blade 42 with respect to swing circle 41 comes closer to neutral position NB of blade 42 with respect to swing circle 41. More specifically, main controller 150 causes blade shift cylinder 47 to operate based on the operation performed onto switch 120 such that the position of blade 42 reaches neutral position NB.

(2) Motor grader 1 includes switch 120, front frame 22, draw bar 40 swingably attached to front frame 22, draw bar shift cylinder 46 attached to draw bar 40, draw bar shift cylinder 46 moving draw bar 40 in the lateral direction with respect to front frame 22, lift cylinders 44 and 45 attached to draw bar 40, lift cylinders 44 and 45 moving draw bar 40 in the direction toward front frame 22 and the direction away from front frame 22, and main controller 150 that causes draw bar shift cylinder 46 and lift cylinders 44 and 45 to operate.

Main controller 150 receives an operation signal from switch 120. Main controller 150 causes draw bar shift cylinder 46 and lift cylinders 44 and 45 to operate based on the received operation signal such that the position of draw bar 40 with respect to front frame 22 comes closer to neutral position ND of draw bar 40 with respect to front frame 22. More specifically, main controller 150 causes draw bar shift cylinder 46 and lift cylinders 44 and 45 to operate based on the operation performed onto switch 120 such that the position of draw bar 40 reaches neutral position ND of draw bar 40.

(e5. Flow of Processing)

Figure 8:
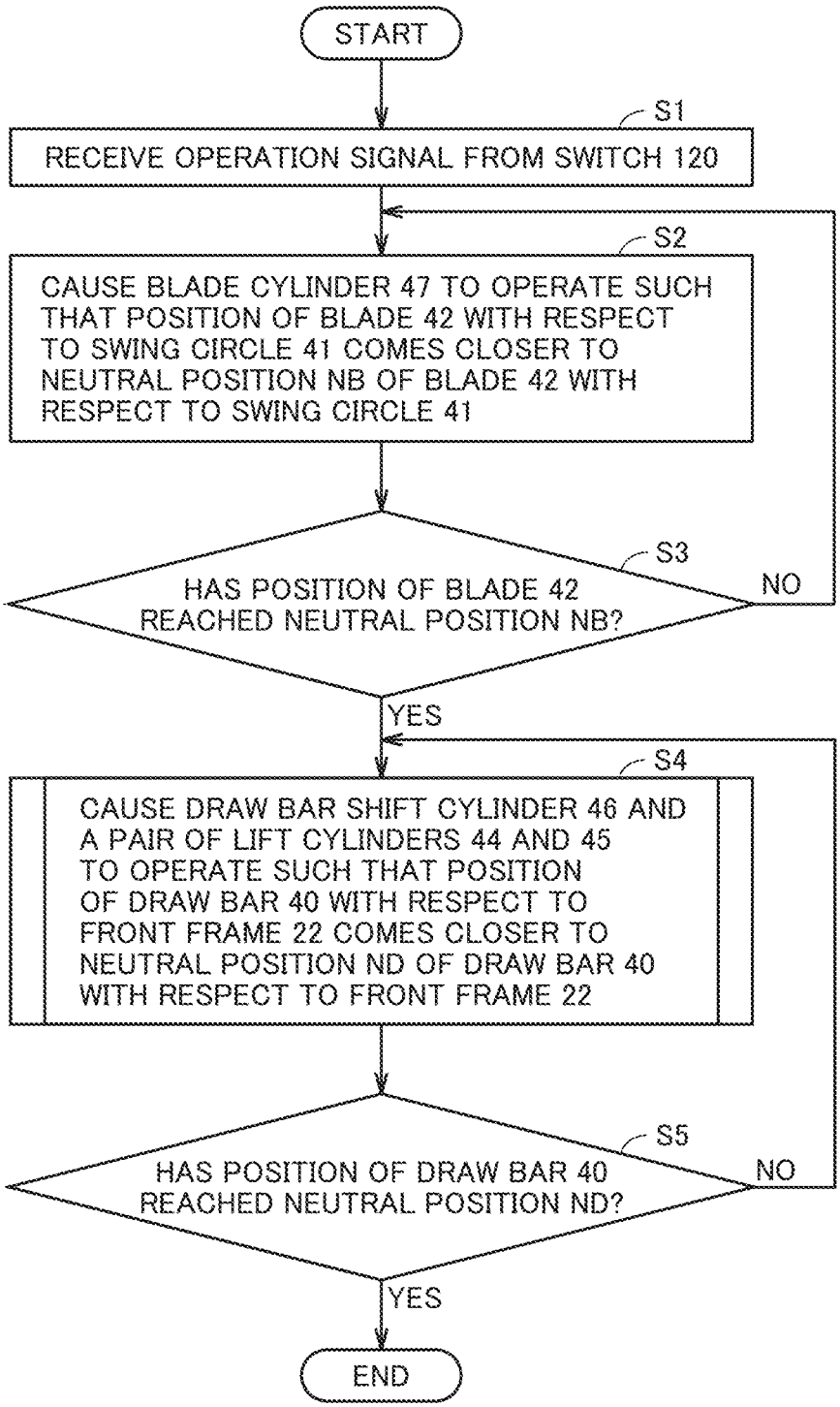
FIG. 8 is a flowchart for illustrating a flow of processing performed in the motor grader.

FIG. 8 is a flowchart for illustrating a flow of processing performed in motor grader 1.

Referring to FIG. 8, in step S1, switch 120 accepts an operation by the operator. Main controller 150 thus receives the operation signal from switch 120.

When main controller 150 receives the operation signal from switch 120, in step S2, main controller 150 causes blade shift cylinder 47 to operate such that the position of blade 42 with respect to swing circle 41 comes closer to neutral position NB of blade 42 with respect to swing circle 41.

In step S3, main controller 150 determines whether or not the position of blade 42 has reached neutral position NB. Specifically, main controller 150 determines whether or not the position of blade 42 has reached neutral position NB based on a result of detection by sensor 177 (see FIG. 3).

When main controller 150 determines that the position of the blade has not reached the neutral position (NO in step S3), the process returns to step S2. When main controller 150 determines that the position of the blade has reached the neutral position (YES in step S3), in step S4, main controller 150 causes draw bar shift cylinder 46 and lift cylinders 44 and 45 to operate such that the position of draw bar 40 with respect to front frame 22 comes closer to neutral position ND of draw bar 40 with respect to front frame 22.

In step S5, main controller 150 determines whether or not the position of draw bar 40 has reached neutral position ND. Specifically, main controller 150 determines whether or not the position of draw bar 40 has reached neutral position ND based on a result of detection by sensor 176.

When main controller 150 determines that the position of the draw bar has not reached the neutral position (NO in step S5), the process returns to step S4. When main controller 150 determines that the position of the draw bar has reached the neutral position (YES in step S5), main controller 150 quits a series of processing.

Figure 9:
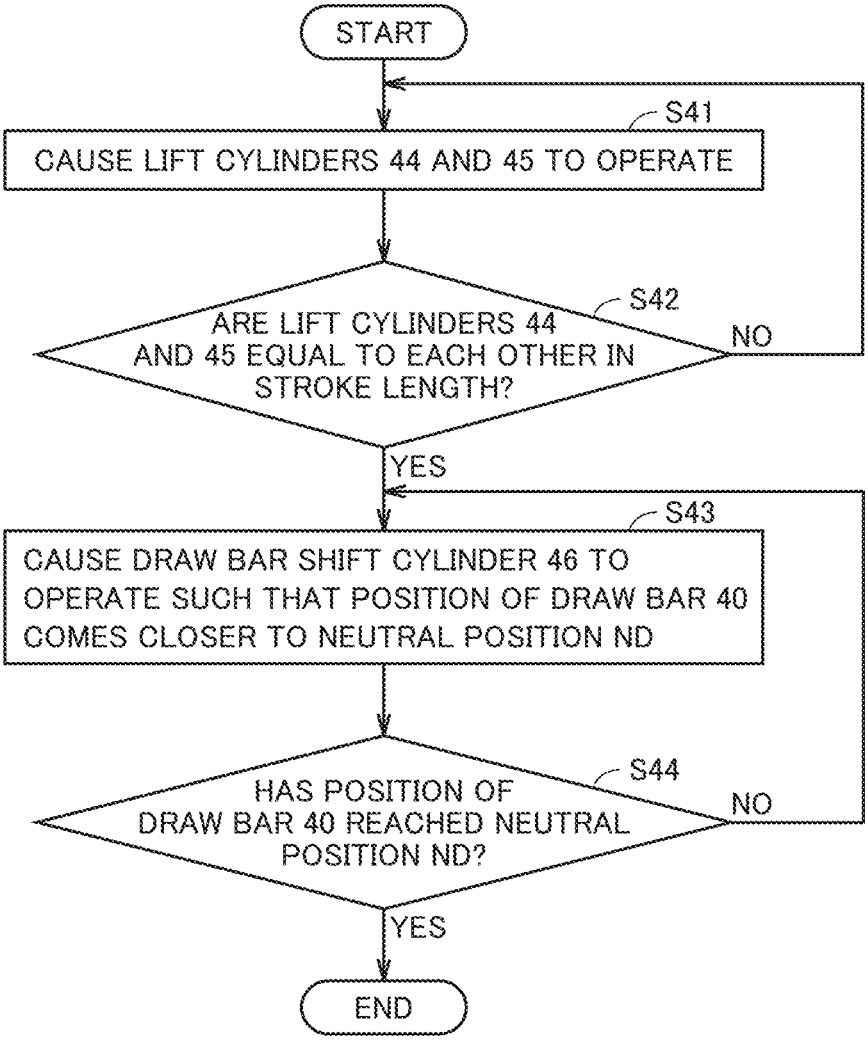
FIG. 9 is a flowchart for illustrating details of processing in step S4 in FIG. 8.

FIG. 9 is a flowchart for illustrating details of processing in step S4 in FIG. 8.

Referring to FIG. 9, in step S41, main controller 150 causes lift cylinders 44 and 45 to operate. In step S42, main controller 150 determines whether or not lift cylinders 44 and 45 are equal in cylinder length to each other. Specifically, main controller 150 determines whether or not the cylinder length of lift cylinder 44 and the cylinder length of lift cylinder 45 are equal to each other based on results of detection by sensors 174 and 175 (see FIG. 3).

When main controller 150 determines that the cylinder lengths are not equal to each other (NO in step S42), the process returns to step S41. When main controller 150 determines that the cylinder lengths are equal to each other (YES in step S42), main controller 150 causes draw bar shift cylinder 46 to operate such that the position of draw bar 40 comes closer to neutral position ND.

In step S44, main controller 150 determines whether or not the position of draw bar 40 has reached neutral position ND. Specifically, main controller 150 determines whether or not the position of draw bar 40 has reached neutral position ND based on the result of detection by sensor 176 (see FIG. 3).

When main controller 150 determines that the position of draw bar 40 has not reached neutral position ND (NO in step S44), the process returns to step S43. When main controller 150 determines that the position of draw bar 40 has reached neutral position ND (YES in step S44), main controller 150 quits a series of processing.

In exemplary processing above, blade 42 is moved to neutral position NB and thereafter draw bar 40 is moved to neutral position ND. Without being limited as such, draw bar 40 may be moved to neutral position ND and thereafter blade 42 may be moved to neutral position NB. Alternatively, an operation to move blade 42 to neutral position NB and an operation to move draw bar 40 to neutral position ND may simultaneously be performed based on the operation performed onto switch 120. By simultaneously moving blade 42 and draw bar 40, a time period for causing work implement 4 to return to the neutral position (causing blade 42 to return to neutral position NB and causing draw bar 40 to return to neutral position ND) can be reduced.

"Being simultaneous" encompasses not only timing of start of movement of blade 42 being identical to timing of start of movement of draw bar 40 but also a state in which blade 42 is being moved and draw bar 40 is being moved at certain timing.

In exemplary processing above, in movement of draw bar 40 to neutral position ND, lift cylinders 44 and 45 are caused to operate and thereafter draw bar shift cylinder 46 is caused to operate. Without being limited as such, draw bar shift cylinder 46 may be caused to operate and thereafter lift cylinders 44 and 45 may be caused to operate. Causing lift cylinders 44 and 45 to operate and thereafter causing draw bar shift cylinder 46 to operate can be less in digging of the ground by blade 42 than causing draw bar shift cylinder 46 to operate and thereafter causing lift cylinders 44 and 45 to operate.

Lift cylinders 44 and 45 may be caused to operate simultaneously with draw bar shift cylinder 46. By simultaneously causing lift cylinders 44 and 45 and draw bar shift cylinder 46 to operate, a time period for draw bar 40 to return to neutral position ND can be shortened.

"Being simultaneous" encompasses not only timing of start of operations of lift cylinders 44 and 45 being identical to timing of start of an operation of draw bar shift cylinder 46 but also a state in which operations of lift cylinders 44 and 45 and an operation of draw bar shift cylinder 46 are being performed at certain timing.

The embodiment disclosed herein is illustrative and not restricted to the above contents alone. The scope of the present invention is defined by the terms of the claims and is intended to include any modifications within the scope and meaning equivalent to the terms of the claims.

REFERENCE SIGNS LIST

1 motor grader; 2 vehicular body frame; 3 cab; 4 work implement; 6 engine compartment; 11 front wheel; 12 rear wheel; 21 rear frame; 22 front frame; 25 exterior cover; 40 draw bar; 41 swing circle; 42 blade; 44, 45 lift cylinder; 46 draw bar shift cylinder; 47 blade shift cylinder; 48 tilt cylinder; 49 slewing motor; 50 bracket; 51 counter weight; 111 travel control lever; 118 work implement lever; 120 switch; 121 monitor apparatus; 134 control valve; 145 potentiometer; 146 starter switch; 148 transmission controller; 149 transmission; 150 main controller; 153 notification unit; 155 memory; 156 control valve control unit; 171, 174, 175, 176, 177 sensor; 402 ball bearing portion; 421 right end; 422 left end; C1 rotation axis; C2 central point; J2 axial line; K centerline; M1, P line; NB, ND neutral position

The invention claimed is:

1. A motor grader comprising:

a front frame;

a draw bar swingably attached to the front frame;

a first actuator attached to the draw bar, the first actuator moving the draw bar in a lateral direction with respect to the front frame;

a second actuator attached to the draw bar, the second actuator moving the draw bar in a direction toward the front frame and a direction away from the front frame;

a controller that causes the first actuator and the second actuator to operate; and an operation apparatus that transmits an operation signal to the controller, when accepting an operation, wherein the controller causes, when receiving the operation signal, the first actuator and the second actuator to start operating such that a position of the draw bar with respect to the front frame comes closer to a neutral position of the draw bar with respect to the front frame, and causes, when determining that the position of the draw bar has reached the neutral position, the first actuator and the second actuator to stop operating.

2. The motor grader according to claim 1, wherein when the controller receives the operation signal from the operation apparatus, the controller causes the first actuator and the second actuator to operate such that the position of the draw bar comes closer to the neutral position of the draw bar on condition that the motor grader is traveling forward.

3. The motor grader according to claim 1, wherein the second actuator is a pair of lift cylinders, and the controller causes the pair of lift cylinders to operate based on the received operation signal such that the lift cylinders are equal to each other in cylinder length, and causes the first actuator to operate such that the position of the draw bar comes closer to the neutral position of the draw bar on condition that the lift cylinders have become equal to each other in cylinder length.

4. The motor grader according to claim 3, wherein the controller causes both of the lift cylinders to operate such that the lift cylinders are equal to each other in cylinder length.

5. The motor grader according to claim 3, wherein the controller causes one of the lift cylinders to operate such that the lift cylinders are equal to each other in cylinder length.

6. The motor grader according to claim 1, wherein the controller causes the first actuator and the second actuator to operate based on the received operation signal such that the position of the draw bar reaches the neutral position of the draw bar.

7. The motor grader according to claim 3, further comprising:

a first sensor that detects a cylinder length of one of the lift cylinders; and a second sensor that detects a cylinder length of the other of the lift cylinders, wherein the controller determines a target cylinder length based on the cylinder length detected by the first sensor and the cylinder length detected by the second sensor at time of reception of the operation signal from the operation apparatus, and causes the pair of lift cylinders to operate such that the cylinder length of each of the lift cylinders attains to the target cylinder length.

8. The motor grader according to claim 7, wherein the first actuator is a draw bar shift cylinder, the motor grader further comprises:

a third sensor that detects a cylinder length of the draw bar shift cylinder; and a storage in which a cylinder length of the draw bar shift cylinder at which the position of the draw bar coincides with the neutral position of the draw bar when a length of the pair of lift cylinders is at the target length is stored in advance, and the controller causes the draw bar shift cylinder to operate based on the received operation signal until the cylinder length detected by the third sensor attains to the cylinder length stored in advance in the storage.

9. A method of controlling a motor grader, the motor grader including a draw bar swingably attached to a front frame, a first actuator attached to the draw bar, the first actuator moving the draw bar in a lateral direction with respect to the front frame, and a second actuator attached to the draw bar, the second actuator moving the draw bar in a direction toward the front frame, a direction away from the front frame, and an operation apparatus that transmits an operation signal to the controller, when accepting an operation, the method comprising:

causing, when receiving the operation signal, the first actuator and the second actuator to start operating such that a position of the draw bar with respect to the front frame comes closer to a neutral position of the draw bar with respect to the front frame, and causing, when determining that the position of the draw bar has reached the neutral position, the first actuator and the second actuator to stop operating.

10. The method of controlling a motor grader according to claim 9, wherein the causing the first actuator and the second actuator to operate includes causing the first actuator and the second actuator to operate such that the position of the draw bar comes closer to the neutral position of the draw bar on condition that the motor grader is traveling forward.

11. The method of controlling a motor grader according to claim 9, wherein the second actuator is a pair of lift cylinders, and the causing the first actuator and the second actuator to operate includes causing the pair of lift cylinders to operate such that the lift cylinders are equal to each other in cylinder length, and causing the first actuator to operate such that the position of the draw bar comes closer to the neutral position of the draw bar on condition that the lift cylinders have become equal to each other in cylinder length.

12. The method of controlling a motor grader according to claim 11, wherein the causing the first actuator and the second actuator to operate includes causing both of the lift cylinders to operate such that the lift cylinders are equal to each other in cylinder length.

13. The method of controlling a motor grader according to claim 11, wherein the causing the first actuator and the second actuator to operate includes causing one of the lift cylinders to operate such that the lift cylinders are equal to each other in cylinder length.

14. The method of controlling a motor grader according to claim 9, wherein the causing the first actuator and the second actuator to operate includes causing the first actuator and the second actuator to operate such that the position of the draw bar reaches the neutral position of the draw bar.

15. The method of controlling a motor grader according to claim 11, wherein the motor grader further includes a first sensor that detects a cylinder length of one of the lift cylinders, and a second sensor that detects a cylinder length of the other of the lift cylinders, and the causing the first actuator and the second actuator to operate includes determining a target cylinder length based on the cylinder length detected by the first sensor and the cylinder length detected by the second sensor at time of reception of the operation signal from the operation apparatus, and causing the pair of lift cylinders to operate such that the cylinder length of each of the lift cylinders attains to the target cylinder length.

16. The method of controlling a motor grader according to claim 15, wherein the first actuator is a draw bar shift cylinder, the motor grader further includes a third sensor that detects a length of the draw bar shift cylinder, and a storage in which a cylinder length of the draw bar shift cylinder at which the position of the draw bar coincides with the neutral position of the draw bar when a cylinder length of the pair of lift cylinders is at the target cylinder length is stored in advance, and the causing the first actuator and the second actuator to operate includes causing the draw bar shift cylinder to operate until the cylinder length detected by the third sensor attains to the cylinder length stored in advance in the storage.

* * * * *